US008164404B2

(12) United States Patent
Kamiya et al.

(10) Patent No.: US 8,164,404 B2
(45) Date of Patent: Apr. 24, 2012

(54) ELECTROMAGNETIC RELAY

(75) Inventors: Makoto Kamiya, Nishio (JP); Manabu Ozaki, Anjo (JP)

(73) Assignee: ANDEN CO., LTD., Anjo (JP)

( * ) Notice: Subject to any disclaimer, the term of this patent is extended or adjusted under 35 U.S.C. 154(b) by 214 days.

(21) Appl. No.: 12/656,122

(22) Filed: Jan. 19, 2010

(65) Prior Publication Data

US 2010/0193475 A1 Aug. 5, 2010

(30) Foreign Application Priority Data

Feb. 2, 2009 (JP) ..... 2009-021438

(51) Int. Cl.
*H01H 9/30* (2006.01)
*H01H 33/08* (2006.01)

(52) U.S. Cl. ..... 335/201; 335/78; 335/202; 218/157

(58) Field of Classification Search ..... 335/78–86, 335/128–130, 201, 202; 218/157
See application file for complete search history.

(56) References Cited

U.S. PATENT DOCUMENTS 5,015,979 A * 5/1991 Nakanishi et al. ..... 335/83
6,222,147 B1 * 4/2001 Doughty et al. ..... 218/157
6,242,707 B1 * 6/2001 Mody et al. ..... 218/1
7,843,682 B2 * 11/2010 Leinen et al. ..... 361/652
2008/0116173 A1 * 5/2008 Sisson et al. ..... 218/157
2010/0066471 A1 * 3/2010 Nagura et al. ..... 335/201

FOREIGN PATENT DOCUMENTS

DE 26 16 005 12/1976
FR 2 315 759 1/1977
JP 2005203290 A * 7/2005
JP A-2005-203290 7/2005

OTHER PUBLICATIONS

The Extended Search Report dated Mar. 11, 2011 in corresponding European Application No. 10000607.1.
The Extended Search Report dated Feb. 16, 2011 in corresponding European Application No. 10014838.6.

* cited by examiner

*Primary Examiner* — Bernard Rojas
(74) *Attorney, Agent, or Firm* — Posz Law Group, PLC

(57) ABSTRACT

An electromagnetic relay includes a resin case, a coil, a movable contact; a fixed contact, a flat recess, a ventilation hole, a cooling member and a flat passage. The resin case has a housing space therein. The movable contact is within the housing space and is actuated by the coil. The fixed contact is within the housing space. The flat recess is formed at the case to communicate with the housing space. The ventilation hole is formed at the case to provide communication between the recess and an exterior of the case. The cooling member is within the recess to cool flame that passes through the recess. The flat passage is formed between the cooling member and an internal wall surface of the recess and has a clearance dimension such that flame is extinguished.

11 Claims, 4 Drawing Sheets

ELECTROMAGNETIC RELAY

CROSS REFERENCE TO RELATED APPLICATION

This application is based on and incorporates herein by reference Japanese Patent Application No. 2009-21438 filed on Feb. 2, 2009.

BACKGROUND OF THE INVENTION

1. Field of the Invention

The present invention relates to an electromagnetic relay that opens and closes an electrical circuit.

2. Description of Related Art

A conventional electromagnetic relay described in JP-A-2005-203290 has a fixed contact and a movable contact. The fixed contact is located and supported at a predetermined position by a fixed contact support, and the movable contact is mounted on a movable body that is actuated by an electromagnetic force of a coil. The above configuration brings the movable contact and the fixed contact into contact with each other, and also separates the movable contact from the fixed contact such that the electrical circuit is opened and closed. Also, a case has a housing space that receives therein components, such as the coil, and the housing space is communicated with an external space of the case through a ventilation hole formed at the case.

However, when the conventional electromagnetic relay having the ventilation hole is used in a condition, where combustible gas is generated, combustible gas may enter into the housing space through the ventilation hole, and thereby combustible gas that has entered into the housing space may be ignited by electric arc generated between the movable contact and the fixed contact. If the generated flame may spread to the external space of the case through the ventilation hole, combustible gas in the external space of the case may be ignited disadvantageously.

SUMMARY OF THE INVENTION

The present invention is made in view of the above disadvantages. Thus, it is an objective of the present invention to address at least one of the above disadvantages.

To achieve the objective of the present invention, there is provided an electromagnetic relay that includes a resin case, a coil, a movable contact, a fixed contact, a flat recess, a ventilation hole, a metal plate cooling member, and a flat passage. The resin case has a housing space therein. The coil is located within the housing space for generating an electromagnetic force when the coil is energized. The movable contact is located within the housing space, wherein the movable contact is actuated by the coil. The fixed contact is located within the housing space, and the movable contact is movable to contact the fixed contact and to be separate from the fixed contact. The flat recess is formed at the case, and the flat recess is communicated with the housing space. The ventilation hole is formed at the case, and the ventilation hole provides communication between the recess and an external space of the case. The metal plate cooling member is located within the recess, and the cooling member cools flame that passes through the recess. The flat passage is formed between the cooling member and an internal wall surface of the case, by which surface the recess is defined. The flat passage has a clearance dimension measured between the cooling member and the internal wall surface of the case. The clearance dimension of the flat passage is designed to be a dimension such that flame is extinguished.

To achieve the objective of the present invention, there is also provided an electromagnetic relay that includes a resin case, a coil, a movable contact, a fixed contact, a ventilation hole, a metal plate cooling member, and a flat passage. The resin case has a housing space therein. The coil is located within the housing space for generating an electromagnetic force when the coil is energized. The movable contact is located within the housing space, wherein the movable contact is actuated by the coil. The fixed contact is located within the housing space, and the movable contact is movable to contact the fixed contact and to be separate from the fixed contact. The ventilation hole is formed at the case, and the ventilation hole provides communication between the housing space and an external space of the case. The metal plate cooling member is provided within the housing space to be opposed to the ventilation hole. The flat passage is defined between the metal plate cooling member and the case. The metal plate cooling member cools flame that passes through the flat passage. The flat passage has a clearance dimension measured between the cooling member and the case. The clearance dimension of the flat passage is designed such that flame is extinguished.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS

Embodiments of the present invention will be described with reference to accompanying drawings. It should be noted that similar components of one embodiment of the present specification, which are similar to the components of the other embodiment, will be designated by the same numerals.

First Embodiment

An electromagnetic relay of the present embodiment is applied to a hybrid vehicle or an electric vehicle, each of which has an electric motor as a travel drive source. More specifically, the hybrid vehicle is mounted with a lithium ion battery that supplies electric power to an electric motor. Also, there is provided an electromagnetic relay in an electrical circuit that has the lithium ion battery (high-voltage DC power source) and an inverter circuit for driving a vehicle.

Battery fluid of a lithium ion battery includes organic solvent, such as dimethyl carbonate (DMC) or ethyl methyl carbonate (EMC). Thus, when temperature of the battery fluid increases, for example, due to overcharge, hydrogen gas is generated, and dimethyl carbonate or ethyl methyl carbonate is evaporated. The above hydrogen gas, dimethyl carbonate gas, and ethyl methyl carbonate gas are combustible gas.

It should be noted that the electromagnetic relay of the present embodiment is applicable to an electric vehicle mounted with a fuel cell. The fuel cell employs hydrogen gas that serves as combustible gas.

Figure 1:
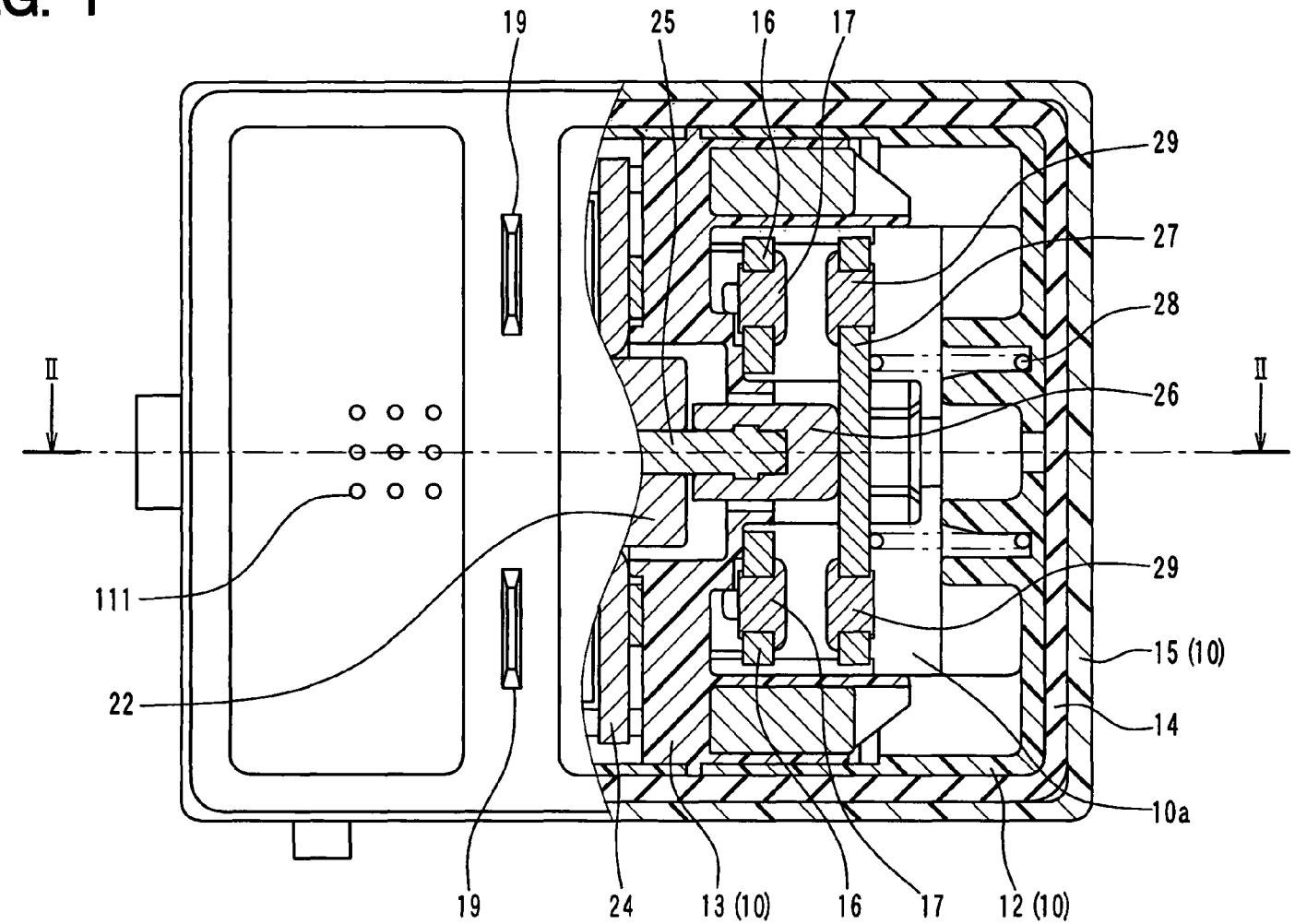
FIG. 1 is a cross-sectional view of a part of an electromagnetic relay according to the first embodiment of the present invention.
Figure 2:
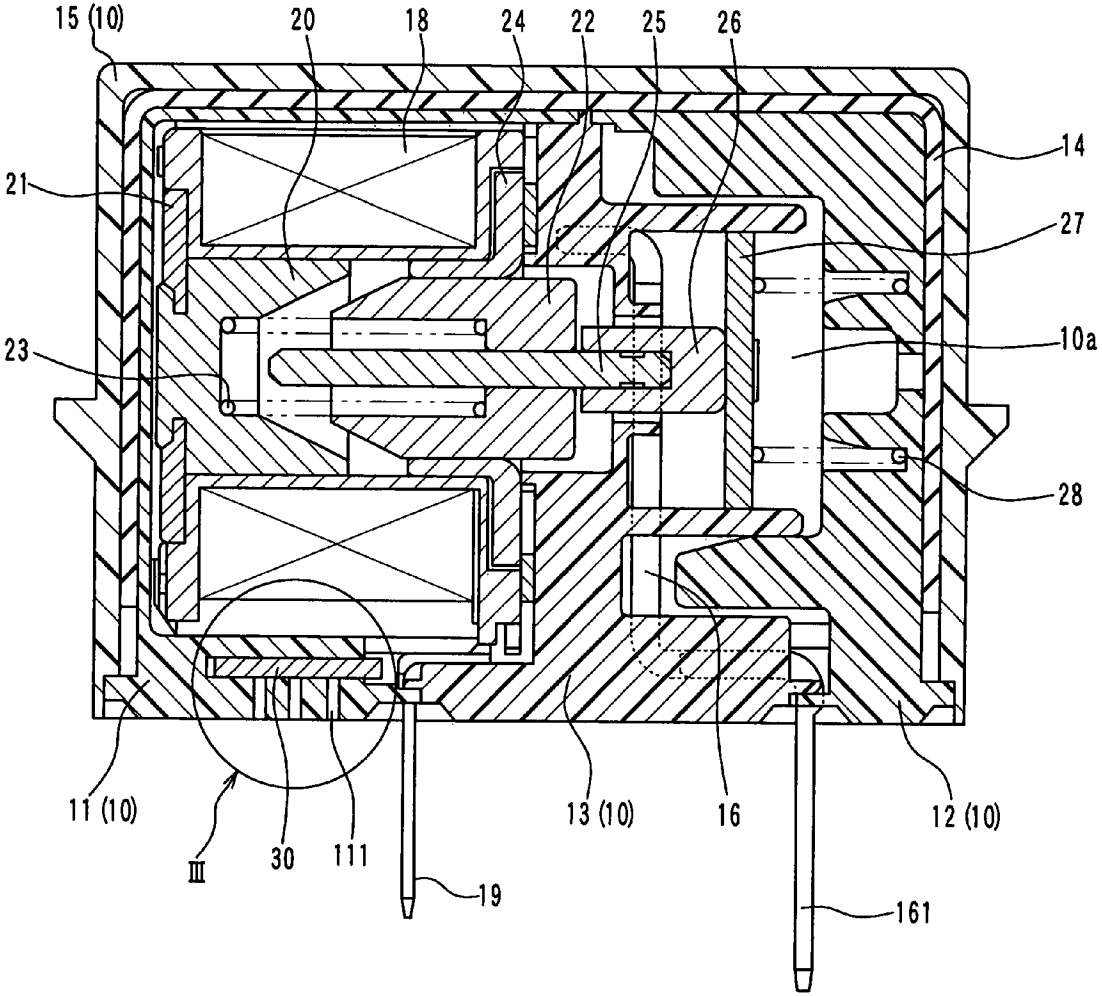
FIG. 2 is a cross-sectional view taken along a line II-II of FIG. 1.

As shown in FIGS. 1 and 2, the electromagnetic relay of the present embodiment has a resin case 10 having a rectangular parallelepiped shape, and the case 10 includes a first case 11, a second case 12, a third case 13, and a cover 15. The first case 11 has a tubular shape with a bottom end, and also, the second case 12 has a tubular shape with a bottom end. The third case 13 is provided between the first case 11 and the second case 12. The cover 15 is made of a resin and has a tubular shape with a bottom end. The first case 11 is provided with multiple ventilation holes 111. More specifically, the first case 11 has nine ventilation holes 111 in the present embodiment. The case 10 has a housing space 10*a* therein, and the housing space 10*a* is communicated with the external space outside the case 10 through the multiple ventilation holes 111.

The case 10 is fitted into a rubber cover 14 that limits noise and vibration. Also, the rubber cover 14 is fitted into the resin cover 15. Both the rubber cover 14 and the resin cover 15 have rectangular parallelepiped shape. Each of the covers 14, 15 has an opening at one end and a bottom at the other end. The case 10 has five faces that are not provided with the ventilation holes 111, and the above five faces are covered by the rubber cover 14 and the resin cover 15.

The third case 13 has two fixed contact supports 16 fixed thereto. The fixed contact supports 16 are made of a conductive metal. Each of the fixed contact supports 16 extends through the case 10 and has one end positioned within the housing space 10*a* and has the other end positioned at the external space outside the case 10. The one end of each of the fixed contact supports 16 within the housing space 10*a* is crimped to and fixed to a fixed contact 17 made of a conductive metal. The fixed contacts 17 are provided at predetermined positions by the fixed contact supports 16, respectively.

The other end of each of the fixed contact supports 16 in the external space is provided with a load circuit terminal 161 that is connected with an external harness (not shown). The load circuit terminal 161 of one of the fixed contact supports 16 is connected with a lithium ion battery (not shown) through the external harness, and the load circuit terminal 161 of the other one of the fixed contact supports 16 is connected to the inverter circuit (not shown) through the external harness.

The first case 11 has therein a hollow cylindrical coil 18 that generates an electromagnetic force when the coil 18 is energized. The coil 18 is connected with two coil terminals 19 that are made of a conductive metal. One end of each of the coil terminals 19 extends to an exterior of the case 10, and is connected to an ECU (not shown) through the external harness, and the coil 18 is energized through the external harnesses and the coil terminals 19.

The coil 18 receives therein a fixed core 20 that is made of a magnetic metal, and there is a magnetic metal yoke 21 that is located at one longitudinal end of the coil 18 and at a position radially outward of the coil 18. The yoke 21 has both ends that are fitted with the second case 12 such that the yoke 21 is fixed to the second case 12. The fixed core 20 is supported by the yoke 21.

There is a magnetic metal movable core 22 disposed at a certain position radially inward of the coil 18 and disposed within the third case 13 such that the movable core 22 is opposed to the fixed core 20. Also, a return spring 23 is provided between the fixed core 20 and the movable core 22 such that the return spring 23 urges the movable core 22 in a direction away from the fixed core 20. When the coil 18 is energized, the movable core 22 is attracted toward the fixed core 20 against the urging force of the return spring 23.

There is a flanged hollow cylindrical plate 24 provided at the other longitudinal end of the coil 18. The plate 24 is made of a magnetic metal and slidably holds the movable core 22. It should be noted that the fixed core 20, the yoke 21, the movable core 22, and the plate 24 forms a magnetic circuit of a magnetic flux induced by the coil 18.

A metal shaft 25 extends through the movable core 22 and is fixed to the movable core 22. The shaft 25 has one end portion that extends to be placed within the third case 13. The one end portion of the shaft 25 is fitted with and fixed to an electrical insulator 26 that is made of a resin having an electrically non-conductive property. The electrical insulator 26 is positioned within the third case 13.

A plate movable body 27 that is made of a conductive metal is provided within the third case 13. There is provided a pressure spring 28 between the movable body 27 and the second case 12, and the pressure spring 28 urges the movable body 27 toward the shaft 25. Two movable contacts 29 made of a conductive metal are crimped to and fixed to the movable body 27 at certain positions such that the movable contacts 29 are opposed to the respective fixed contacts 17. The movable contact 29 is movable to contact the fixed contact 17 and to be separate from the fixed contact 17.

Figure 3:
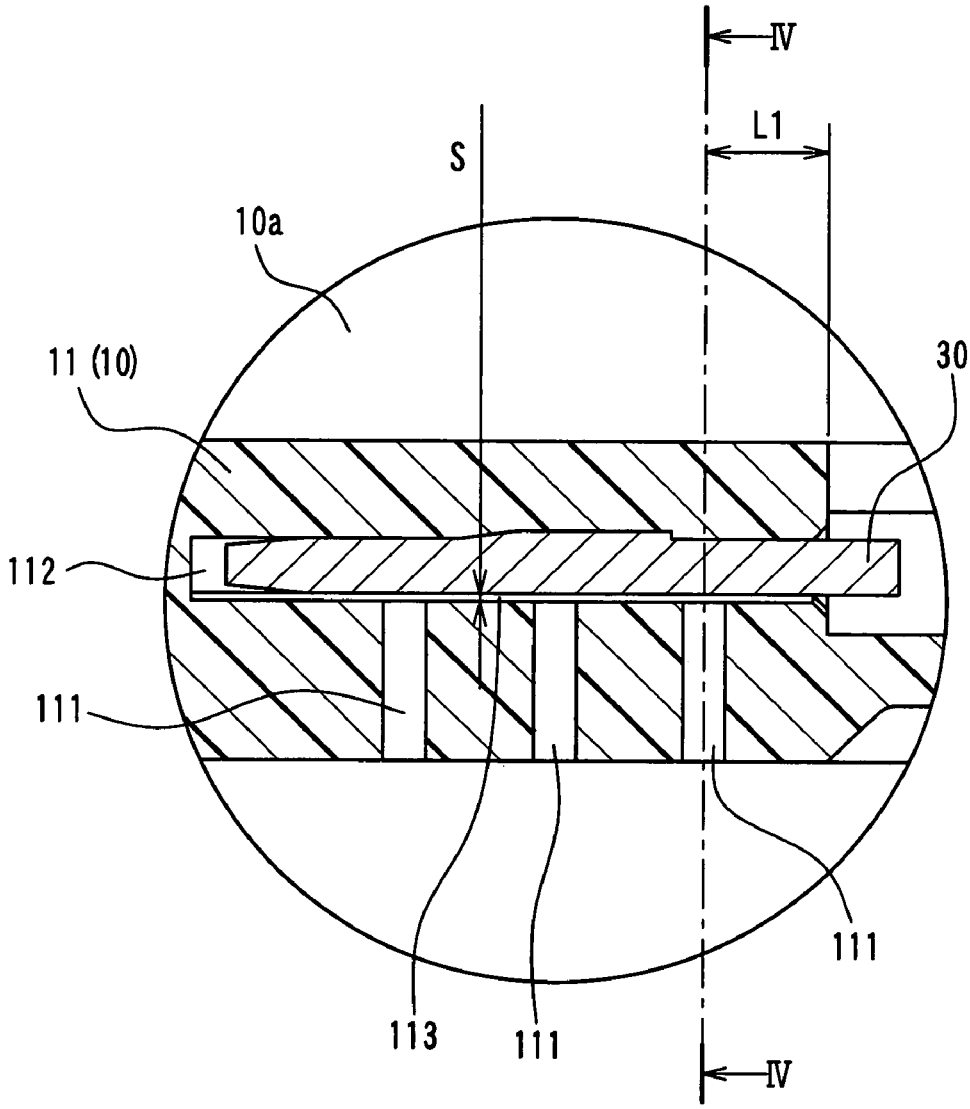
FIG. 3 is an enlarged cross-sectional view of a part III in FIG. 2.
Figure 4:
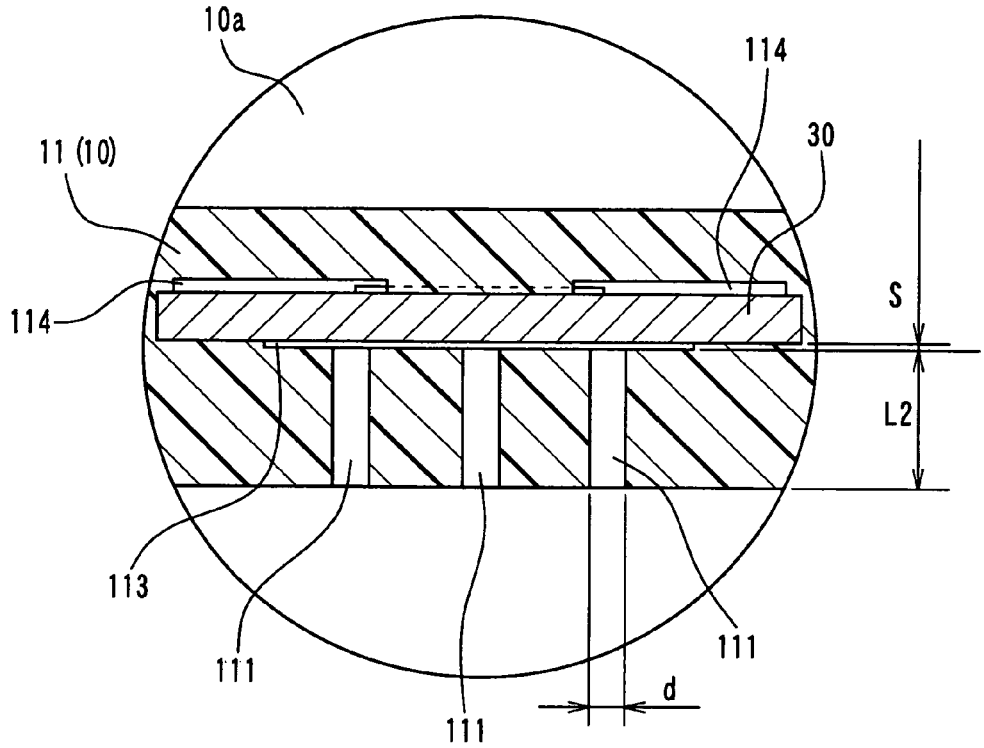
FIG. 4 is a cross-sectional view taken along a line IV-IV of FIG. 3.

As shown in FIGS. 3 and 4; the first case 11 has a wall that corresponds to the face provided with the ventilation holes 111, and the above wall of the first case 11 has a flat recess 112 formed therein. The recess 112 has a generally rectangular parallelepiped shape and provides communication between the housing space 10*a* and the ventilation holes 111. The recess 112 has an opening portion that opens to the housing space 10*a*, and the opening portion has a flat rectangular shape when observed from the housing space 10*a*. For example, the opening portion of the recess 112 has the flat rectangular shape when observed in a direction along the shaft 25 from the housing space 10*a*.

The recess 112 receives therein a plate metal heat absorber 30 configured to cool flame that passes through the recess 112. More specifically, the heat absorber 30 is made of copper and has a generally flat rectangular parallelepiped shape. It should be noted that the heat absorber 30 serves as a cooling member.

The recess 112 is defined by a first internal wall surface and a second internal wall surface of the first case 11 of the case 10. The first internal wall surface has the ventilation holes 111 opening thereon, and the second internal wall surface is opposed to the first internal wall surface in a direction generally perpendicular to the plane of the heat absorber 30, for example. A first flat passage 113 is formed between the heat absorber 30 and the first internal wall surface of the first case 11. The first flat passage 113 has a generally flat rectangular parallelepiped shape. Also, a second flat passage 114 is formed between the heat absorber 30 and the second internal wall surface of the first case 11. The second flat passage 114 has a generally flat rectangular parallelepiped shape.

The first flat passage 113 has a clearance dimension S that is measured between the heat absorber 30 and the internal wall surface of the first case 11, at which the ventilation holes 111 are formed. The clearance dimension S of the first flat passage 113 is designed to be a dimension such that it is possible to extinguish the flame that passes through the first flat passage 113. More specifically, the clearance dimension S is equal to or smaller than 0.15 mm. Also, a passage length L1 is measured between the opening portion of the first flat passage 113 to one of the ventilation holes 111, which is closest to the opening portion of the first flat passage 113. In the above condition, the passage length L1 is equal to or greater than 1.5 mm.

It should be noted that the ventilation holes 111 are circular holes or have circular cross sections. Also, all of the ventilation holes 111 are located at certain positions such that the ventilation holes 111 are opposed to the heat absorber 30. Each of the ventilation holes 111 has an inner diameter d (or passage area) having a certain dimension (or certain passage area) such that flame is extinguished. In other words, the inner diameter d (or passage area) is set to be a certain value such that it is possible to extinguish flame. Specifically, the inner diameter d is designed to be equal to or less than 0.75 mm. Also, each of the ventilation holes 111 has a hole length L2 that is equal to or greater than 2 mm (see FIG. 4).

Next, operation of the electromagnetic relay of the present embodiment will be described. Firstly, when the coil 18 is energized, the electromagnetic force attracts the movable core 22 toward the fixed core 20 against the force of the return spring 23, and thereby the movable body 27 is urged by the pressure spring 28 such that the movable body 27 is displaced to follow the movable core 22. As a result, the two movable contacts 29 contact the two fixed contacts 17, respectively, and thus establishing the conduction between the two load circuit terminals 161.

In contrast, when the coil 18 is deenergized, the return spring 23 urges the movable core 22 and the movable body 27 in a direction away from the fixed core against the urging force of the pressure spring 28. As a result, the two movable contacts 29 are moved apart from the two fixed contacts 17, and thereby the conduction between the load circuit terminals 161 is disabled.

As above, the electromagnetic relay of the present embodiment is employed in an environment, where combustible gas may be generated. Also, when combustible gas is generated, combustible gas flows into the housing space 10*a* through the ventilation holes 111 of the case 10, and combustible gas that has entered into the housing space 10*a* may be ignited by electric arc generated between the fixed contacts 17 and the movable contacts 29.

Flame of the ignited combustible gas by electric arc may move toward the ventilation holes 111 from the housing space 10*a* through the first flat passage 113. When the flame passes through the first flat passage 113, heat of the flame is taken away by the first case 11 and the heat absorber 30, and thereby it is impossible to maintain the flame. As a result, flame disappears eventually.

Also, flame of combustible gas ignited by electric arc may flows into the second flat passage 114 from the housing space 10*a*, and subsequently flow toward the ventilation holes 111 through the first flat passage 113. When flame passes through the second flat passage 114, heat of flame is taken away by the first case 11 and the heat absorber 30. Furthermore, heat of flame is also taken away by the first case 11 and the heat absorber 30 when flame passes through the first flat passage 113, and thereby it is impossible to maintain the flame. As a result, flame disappears. In the present embodiment, because the heat absorber 30 is made of a metal that has a heat capacity greater than a heat capacity of a resin, it is possible to take away more heat from flame that passes through the first flat passage 113 and the second flat passage 114.

As a result, it is possible to limit flame of combustible gas ignited by electric arc from spreading to the external space of the case 10, and thereby it is possible to prevent the ignition of combustible gas in the external space of the case 10.

Furthermore, even in a case, where flame does not disappear while flame passes through the first flat passage 113, heat of flame is further taken away by the first case 11 when flame subsequently passes through the ventilation holes 111. As a result, it is possible to extinguish flame. As a result, it is possible to reliably prevent flame of combustible gas that is ignited by electric arc from spreading to the external space outside the case 10.

Also, in the present embodiment, because the multiple ventilation holes 111 are provided, it is possible to sufficiently obtain a total passage area of the ventilation holes 111, and thereby sufficient ventilation is reliably achievable.

In the present embodiment, each of the ventilation holes 111 has a cross section of a circular shape. However, the ventilation hole 111 may alternatively have another cross-sectional shape (for example, a rectangular shape) other than the circular shape. Also, in the present embodiment, the ventilation holes 111 are provided to be opposed to the heat absorber 30. However, the ventilation holes 111 may be arranged at a position such that the ventilation holes 111 are not opposed to the heat absorber 30.

Second Embodiment

The present embodiment employs a different method for fixing the heat absorber 30 different from a method in the first embodiment, and does not employ the recess 112 of the first embodiment. Other structure of the present embodiment is similar to the structure in the first embodiment.

Figure 5:
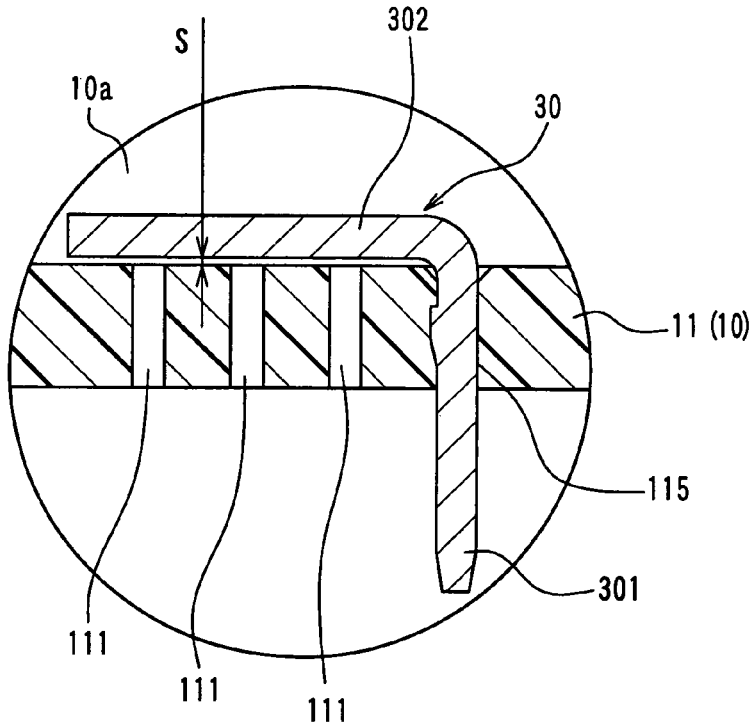
FIG. 5 is a cross-sectional view of a part of an electromagnetic relay according to the second embodiment of the present invention.

As shown in FIG. 5, the first case 11 is formed with a through bore 115 adjacent the ventilation holes 111. The heat absorber 30 is bent to have an L-shape and has a press-fit plate portion 301 and a cover plate portion 302. The press-fit plate portion 301 is press fitted into the through bore 115, and the cover plate portion 302 is positioned within the first case 11 to cover the ventilation holes 111.

The heat absorber 30 is fixed to the first case 11 by press fitting the press-fit plate portion 301 into the through bore 115, and thereby the recess 112 is not required in the present embodiment (see FIG. 3).

The first flat passage 113 is formed between the cover plate portion 302 and an internal wall surface of the first case 11. The clearance dimension S of the first flat passage 113 is measured between the cover plate portion 302 and the internal wall surface of the first case 11. The clearance dimension S of the first flat passage 113 is designed such that it is possible to extinguish flame that passes through the first flat passage 113.

Part of flame of combustible gas ignited by electric arc may spread toward the ventilation holes 111 from the housing space 10*a* through the first flat passage 113. Heat of the above flame is taken away by the first case 11 and the heat absorber 30 when flame passes through the first flat passage 113.

As a result, it is impossible to maintain the flame, and thereby flame disappears or is extinguished.

In the present embodiment, the heat absorber 30 covers the ventilation holes 111. However, the coil terminals 19 that are made of the conductive metal may also serve as a heat absorber. Specifically, the coil terminal 19 may be bent as required to form a counterpart that corresponds to the cover plate portion 302 of the heat absorber 30. In the above case, the counterpart covers the ventilation holes 111. As above, the coil terminal 19 may serve as a cooling member.

Additional advantages and modifications will readily occur to those skilled in the art. The invention in its broader terms is therefore not limited to the specific details, representative apparatus, and illustrative examples shown and described.

What is claimed is:

1. An electromagnetic relay comprising:

a resin case having a housing space therein;

a coil located within the housing space for generating an electromagnetic force when the coil is energized;

a movable contact located within the housing space, wherein the movable contact is actuated by the coil;

a fixed contact located within the housing space, wherein the movable contact is movable to contact the fixed contact and to be separate from the fixed contact;

a flat recess that is formed at the case, wherein the flat recess is communicated with the housing space;

a ventilation hole that is formed at the case, wherein the ventilation hole provides communication between the recess and an external space of the case;

a metal plate cooling member located within the recess, wherein the cooling member cools flame that passes through the recess; and a flat passage that is formed between the cooling member and an internal wall surface of the case, by which surface the recess is defined, wherein:

the flat passage has a clearance dimension measured between the cooling member and the internal wall surface of the case; and the clearance dimension of the flat passage is designed to be a dimension such that flame is extinguished.

2. The electromagnetic relay according to claim 1, wherein the ventilation hole has a passage area such that flame is extinguished.

3. The electromagnetic relay according to claim 1, wherein the ventilation hole is one of a plurality of ventilation holes.

4. The electromagnetic relay according to claim 1, wherein the ventilation hole has a circular cross section.

5. The electromagnetic relay according to claim 1, wherein the ventilation hole is positioned to be opposed to the cooling member.

6. An electromagnetic relay comprising:

a resin case having a housing space therein;

a coil located within the housing space for generating an electromagnetic force when the coil is energized;

a movable contact located within the housing space, wherein the movable contact is actuated by the coil;

a fixed contact located within the housing space, wherein the movable contact is movable to contact the fixed contact and to be separate from the fixed contact;

a ventilation hole that is formed at the case, wherein the ventilation hole provides communication between the housing space and an external space of the case;

a metal plate cooling member that is provided within the housing space to be opposed to the ventilation hole; and a flat passage that is defined between the cooling member and the case, wherein:

the cooling member cools flame that passes through the flat passage;

the flat passage has a clearance dimension measured between the cooling member and the case; and the clearance dimension of the flat passage is designed to be a dimension such that flame is extinguished.

7. The electromagnetic relay according to claim 6, wherein the ventilation hole has a passage area such that flame is extinguished.

8. The electromagnetic relay according to claim 6, wherein the ventilation hole is one of a plurality of ventilation holes.

9. The electromagnetic relay according to claim 6, wherein the ventilation hole has a circular cross section.

10. The electromagnetic relay according to claim 6, wherein the ventilation hole is positioned to be opposed to the cooling member.

11. The electromagnetic relay according to claim 6, wherein the cooling member is a coil terminal that is connected to the coil.

* * * * *